US008413990B2

(12) United States Patent
Allshouse et al.

(10) Patent No.: US 8,413,990 B2
(45) Date of Patent: Apr. 9, 2013

(54) PROJECTILE PASSING GAME SYSTEMS

(75) Inventors: James R. Allshouse, Newburgh, IN (US); Safari Chung, Taipei (TW)

(73) Assignee: Indian Industries, Inc., Evansville, IN (US)

( * ) Notice: Subject to any disclaimer, the term of this patent is extended or adjusted under 35 U.S.C. 154(b) by 238 days.

(21) Appl. No.: 12/889,603

(22) Filed: Sep. 24, 2010

(65) Prior Publication Data

US 2011/0070981 A1 Mar. 24, 2011

Related U.S. Application Data

(60) Provisional application No. 61/363,838, filed on Jul. 13, 2010, provisional application No. 61/245,442, filed on Sep. 24, 2009.

(51) Int. Cl.
*F41J 5/00* (2006.01)
*A63B 63/00* (2006.01)
*A63B 69/00* (2006.01)

(52) U.S. Cl. ..... 273/371; 473/455; 473/438; 473/446; 273/402

(58) Field of Classification Search ..... 273/371–377, 273/402; 473/455, 456
See application file for complete search history.

(56) References Cited

U.S. PATENT DOCUMENTS

| | | | | |
|---|---|---|---|---|
| 139,425 | A | | 5/1873 | Schindler |
| 747,726 | A | | 12/1903 | Karhan |
| 884,605 | A | | 4/1908 | McEvoy |
| 1,979,177 | A | | 10/1934 | Staff |
| 3,856,298 | A | * | 12/1974 | Frantti ..... 473/446 |
| 4,004,804 | A | | 1/1977 | Gholson |
| 4,063,728 | A | | 12/1977 | Zemanek |
| 4,070,025 | A | | 1/1978 | Wiser |
| 4,089,526 | A | | 5/1978 | Olving |
| 4,160,550 | A | | 7/1979 | Barrett |
| 4,216,963 | A | | 8/1980 | Boucher |
| 4,251,072 | A | | 2/1981 | Anthony |
| 4,257,600 | A | | 3/1981 | Goldfarb |
| 4,305,581 | A | | 12/1981 | Neuharth |
| 4,330,776 | A | | 5/1982 | Dennison et al. |
| 4,519,607 | A | | 5/1985 | Schill |
| 4,763,903 | A | * | 8/1988 | Goodwin et al. ..... 273/371 |

(Continued)

OTHER PUBLICATIONS

Application for "Multi-Game Table Assembly", U.S. Appl. No. 12/570,196, filed Sep. 30, 2009 (unpublished).

(Continued)

*Primary Examiner* — Mark Graham
(74) *Attorney, Agent, or Firm* — Woodard, Emhardt, Moriarty, McNett & Henry LLP

(57) ABSTRACT

A game system comprises a base game-playing structure and at least two target surfaces each defining at least one target zone and depicting different projectile-passing games. The target surfaces are engageable with the base game-playing structure in one or more substantially vertical orientations and configured to receive passed projectiles. The system also includes at least one sensor engaged with the base game-playing structure. The target zone is positioned at a location on the target surface which is aligned with the sensor. The sensor is configured to detect the presence of a projectile at the target zone. The system may also include an electronic display configured to display the status of the game being played with the game system, and an electronic controller configured to receive signals from the sensor and coupled to the electronic display to reflect the status of the game.

4 Claims, 10 Drawing Sheets

U.S. PATENT DOCUMENTS

| | | | | | |
|---|---|---|---|---|---|
| 4,789,932 | A | * | 12/1988 | Cutler et al. | 700/92 |
| 4,927,140 | A | | 5/1990 | Pappas | |
| 4,927,160 | A | * | 5/1990 | Nichol et al. | 273/371 |
| 5,419,549 | A | * | 5/1995 | Galloway et al. | 473/431 |
| 5,549,302 | A | * | 8/1996 | Lapsker et al. | 473/416 |
| 5,607,155 | A | | 3/1997 | Campbell | |
| 5,746,660 | A | | 5/1998 | Grover | |
| 5,752,886 | A | | 5/1998 | Tien | |
| 5,993,334 | A | * | 11/1999 | McNamara | 473/446 |
| 6,082,736 | A | | 7/2000 | Barlow | |
| 6,109,607 | A | | 8/2000 | Cartwright et al. | |
| 6,155,564 | A | | 12/2000 | Tsai | |
| 6,347,797 | B1 | | 2/2002 | Tsai | |
| 6,349,939 | B1 | | 2/2002 | Tsai | |
| 6,419,224 | B1 | | 7/2002 | Tsai | |
| 6,502,819 | B2 | | 1/2003 | Rieber et al. | |
| 6,595,878 | B1 | * | 7/2003 | Nelson | 473/476 |
| 6,616,141 | B2 | | 9/2003 | Diamant | |
| 6,764,409 | B1 | | 7/2004 | Voden | |
| 6,926,278 | B2 | | 8/2005 | Bibi | |
| D537,888 | S | | 3/2007 | Boettcher | |
| 7,393,291 | B2 | * | 7/2008 | Huang et al. | 473/456 |
| 7,523,942 | B2 | | 4/2009 | Chung | |
| 7,661,679 | B2 | * | 2/2010 | Mah et al. | 273/371 |
| 7,775,525 | B2 | * | 8/2010 | Staver et al. | 273/317.5 |
| 2003/0030218 | A1 | * | 2/2003 | Zucchi et al. | 273/371 |
| 2004/0132536 | A1 | | 7/2004 | Voden | |
| 2004/0132537 | A1 | | 7/2004 | Voden | |
| 2005/0049056 | A1 | | 3/2005 | Padilla | |
| 2005/0064945 | A1 | | 3/2005 | Voden | |
| 2005/0107177 | A1 | | 5/2005 | Arias | |
| 2005/0250589 | A1 | | 11/2005 | Voden | |
| 2005/0255928 | A1 | | 11/2005 | Nally | |
| 2009/0298622 | A1 | * | 12/2009 | Roberts | 473/455 |
| 2010/0090407 | A1 | * | 4/2010 | Lin | 273/371 |

OTHER PUBLICATIONS

Sears website pages advertizing rotating game tables, http://www.sears.com/shc/s/search_10153_12605?keyword=multi-game+tables.x=0&gobotton-find.

United States Patent Office non-final office action issued on Sep. 3, 2010 on U.S. Appl. No. 12/570,196.

* cited by examiner

PROJECTILE PASSING GAME SYSTEMS

CROSS-REFERENCE TO RELATED APPLICATIONS

This application claims the benefit of U.S. Provisional Application No. 61/363,838, filed Jul. 13, 2010, and U.S. Provisional Application No. 61/245,442, filed Sep. 24, 2009, which are hereby incorporated by reference.

FIELD OF THE DISCLOSURE

The present disclosure relates generally to the field of recreational games, and more specifically provides certain projectile passing game systems.

BACKGROUND OF THE DISCLOSURE

Sports such as football and baseball are quite popular and many people enjoy watching or playing such games. In order to play an actual game, it can sometimes be difficult to find the substantial amount of room needed as well as a sufficient number of players to form teams. Other factors, such as weather and the potential for injury, have also been known to make arranging a game difficult. Accordingly, there has developed a need and market for indoor or smaller scale games or practice facilities which can be played with less room and require fewer people. Such games can be set up, for example, in basements, garages, game rooms, gyms, fairs, party facilities or otherwise and preferably can be played in a relatively small area with one or two people.

Some games have been suggested which include various targets, physical arrangements and scoring apparatus. However, many of these games have been limited in game variety, structural complexity, size and shape. The present disclosure is directed to addressing such limitations.

SUMMARY OF THE INVENTION

In certain embodiments, a game system comprises a base game-playing structure and at least two target surfaces each defining at least one target zone. The target surfaces are engageable with the base game-playing structure in one or more substantially vertical orientations and configured to receive passed projectiles. Additionally, each of the target surfaces depicts a different projectile-passing game to be played with the game system. The system also includes at least one sensor engaged with the base game-playing structure. The target zone is positioned at a location on the corresponding target surface which is aligned with the sensor when the corresponding target surface is engaged with the base game-playing structure. The sensor is configured to detect the presence of a projectile at the target zone when the corresponding target surface is engaged with the base game-playing structure. Additionally, the system includes an electronic display configured to display the status of the game being played with the game system, and an electronic controller configured to receive signals from the sensor and coupled to the electronic display to reflect the status of the game.

In certain other embodiments, a game-playing apparatus comprises a frame and backboard assembly and at least two target surfaces each defining at least one target zone impact area. The target surfaces are engageable with the frame and backboard assembly in a substantially vertical orientation and configured to receive passed projectiles. Additionally, each surface depicts a different projectile-passing game to be played with the game-playing apparatus. The system includes at least one impact sensor mounted to the frame and backboard assembly. The target zone impact area is positioned at a location on the target surface which is aligned with the impact sensor when the corresponding target surface is engaged with the frame and backboard assembly. The sensor is configured to detect if projectile impacts the target surface within the target zone impact area when the corresponding target surface is engaged with the frame and backboard assembly. The system further includes an electronic display system configured to receive signals from the sensor and display the status of the game being played with the game-playing apparatus.

In yet other embodiments, a kit comprises a base stand, a frame engageable with the base stand in a substantially vertical orientation, and a backboard panel carried by the frame. The kit also includes at least two target panels each defining at least one target zone impact area, the target panels being selectively and interchangeably engageable with the frame or backboard panel in a substantially vertical orientation and configured to receive passed projectiles. Each panel depicts a different projectile-passing game to be played. Additionally, the kit includes at to least one impact sensor mounted on the backboard panel. The target zone impact area is positioned at a location on the corresponding target panel which is aligned with the impact sensor when the target panel is engaged with the frame or backboard panel, wherein the sensor is configured to detect if projectile impacts the target panel within the target zone impact area when the corresponding target panel is engaged with the frame or backboard panel. The kit may further include an electronic display system configured to receive signals from the sensor and display the status of the game being played.

Other features, objects and advantages of the present invention will be evident to one of ordinary skill in the art from the accompanying description and drawings.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles of the disclosure being contemplated as would normally occur to one skilled in the art to which the disclosure relates.

In certain embodiments, the present disclosure provides projectile passing game systems for passing projectiles toward target zones, including defined impact areas or defined target holes in target surfaces mounted on a multi-game device. The system includes different target surfaces which may be engaged with a base frame and backboard assembly, with the base frame and backboard assembly having sensors to track projectiles impacting the target areas or passing through the target holes in the target surfaces. In this way, the sensors are usable with different target surfaces. The target surfaces are positioned on target panels and depict different games such that projectiles may be passed toward the different target surfaces for playing the different games. Use of the term "passing" is intended to include a variety of actions, such as kicking, throwing, tossing, impelling, propelling, flinging, projecting or otherwise urging a projectile toward a defined target zone or hole, to name a few non-limiting examples.

In embodiments in which projectiles are passed through target holes, the sensors are engaged with the base frame of the multi-game device and include one or more passing sensors having beams extending horizontally within the frame and aligned with target holes in the target surfaces. In embodiments in which projectiles are passed toward target impact areas, the sensors include one or more impact sensors mounted on the backboard and aligned with target impact areas in the target surfaces. Additionally, the system may optionally include multiple game-playing target panels carrying the target surfaces which may be selectively and interchangeably mounted on the device to allow multiple projectile-passing games to be played. Further, the system may include electronics operable to selectively illuminate one or more of the target zones or target holes randomly or in various sequences to designate scoring targets. A display for showing game status indicators may also be included in the system.

Figure 8A:
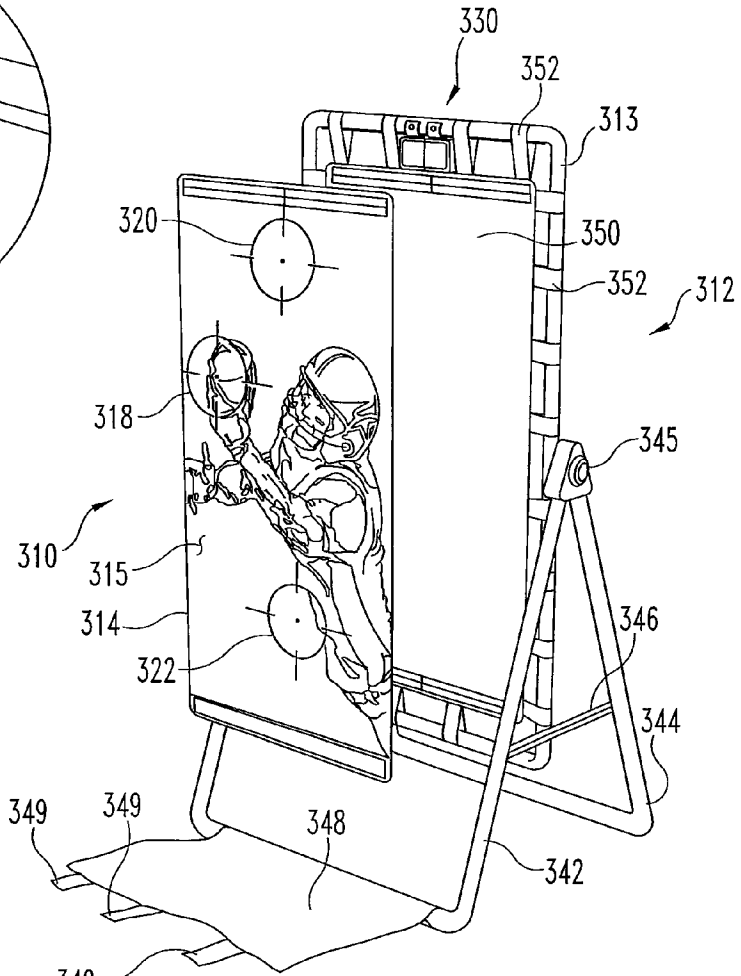
FIG. 8A is a perspective view of a projectile passing game system according to an embodiment of the present disclosure.
Figure 8C:
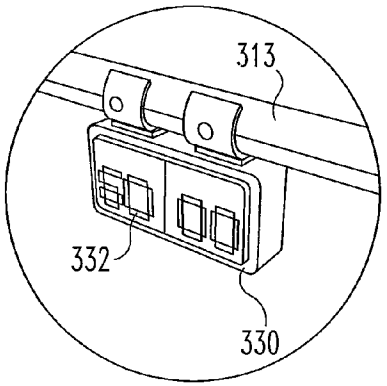
FIG. 8C is a perspective view of the scoring display of FIG. 8A.
Figure 8B:
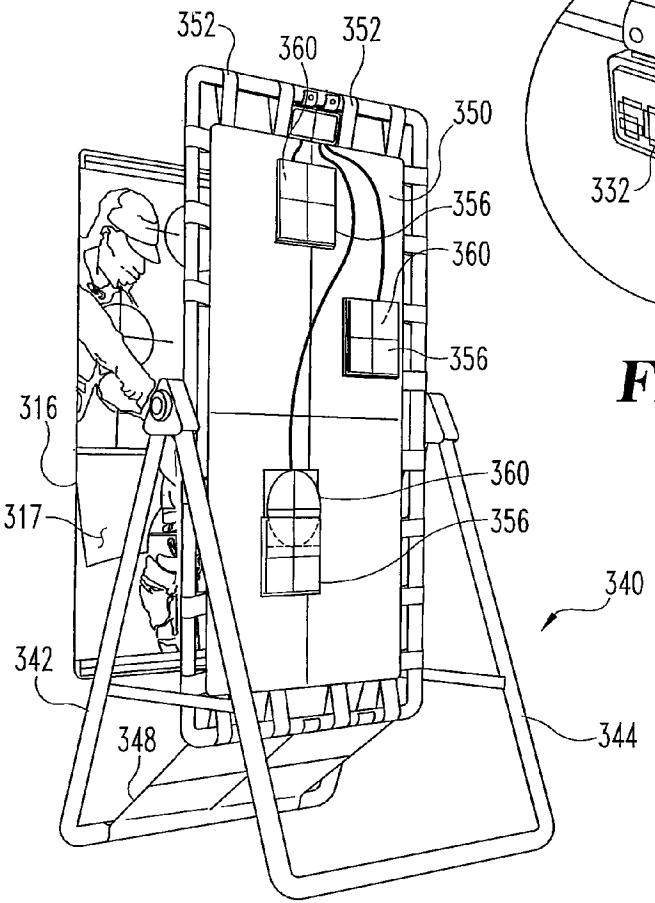
FIG. 8B is a rear perspective view of the projectile passing game system of FIG. 8A.
Figure 9:
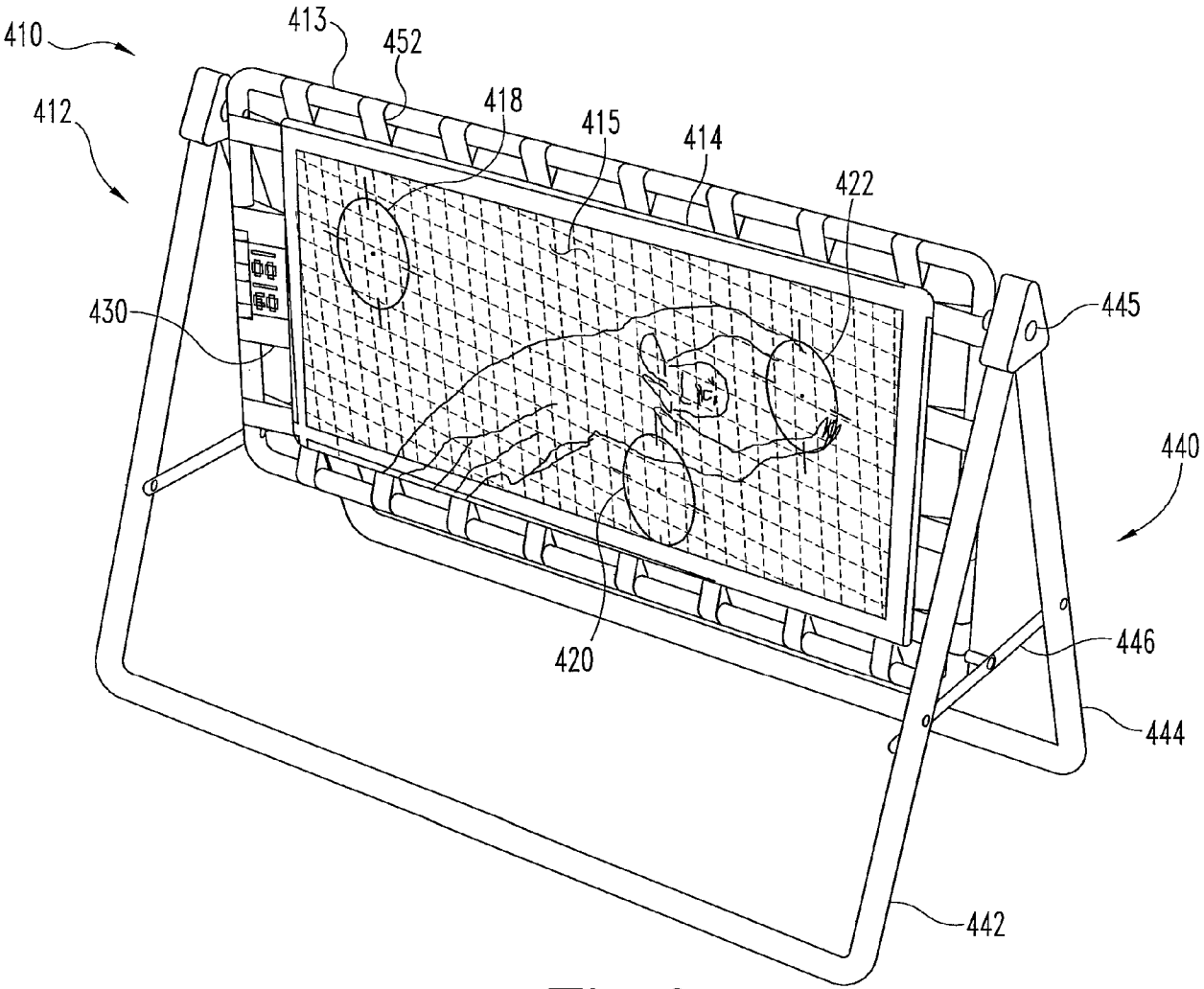
FIG. 9 is a perspective view of a projectile passing game system according to yet another embodiment of the present disclosure.

As an overview of the embodiments and corresponding illustrations, FIGS. 1-4 show an example dual-sided projectile passing game system in which projectiles are passed through defined target holes in target surfaces on both sides of the device, with a single set of sensors positioned between the target surfaces. FIGS. 5-7C illustrate an example projectile passing game system in which projectiles are passed toward defined target zones on different target surfaces engageable with the device, with sensors positioned on the device. FIGS. 8A-8C illustrate another example projectile passing game system in which projectiles are passed toward defined target zones on different target surfaces engageable with the device, with sensors positioned on the device. FIG. 9 illustrates yet another example projectile passing game system in which projectiles are passed toward defined target zones on target surfaces engageable with the device, with sensors positioned on the device.

Figure 1:
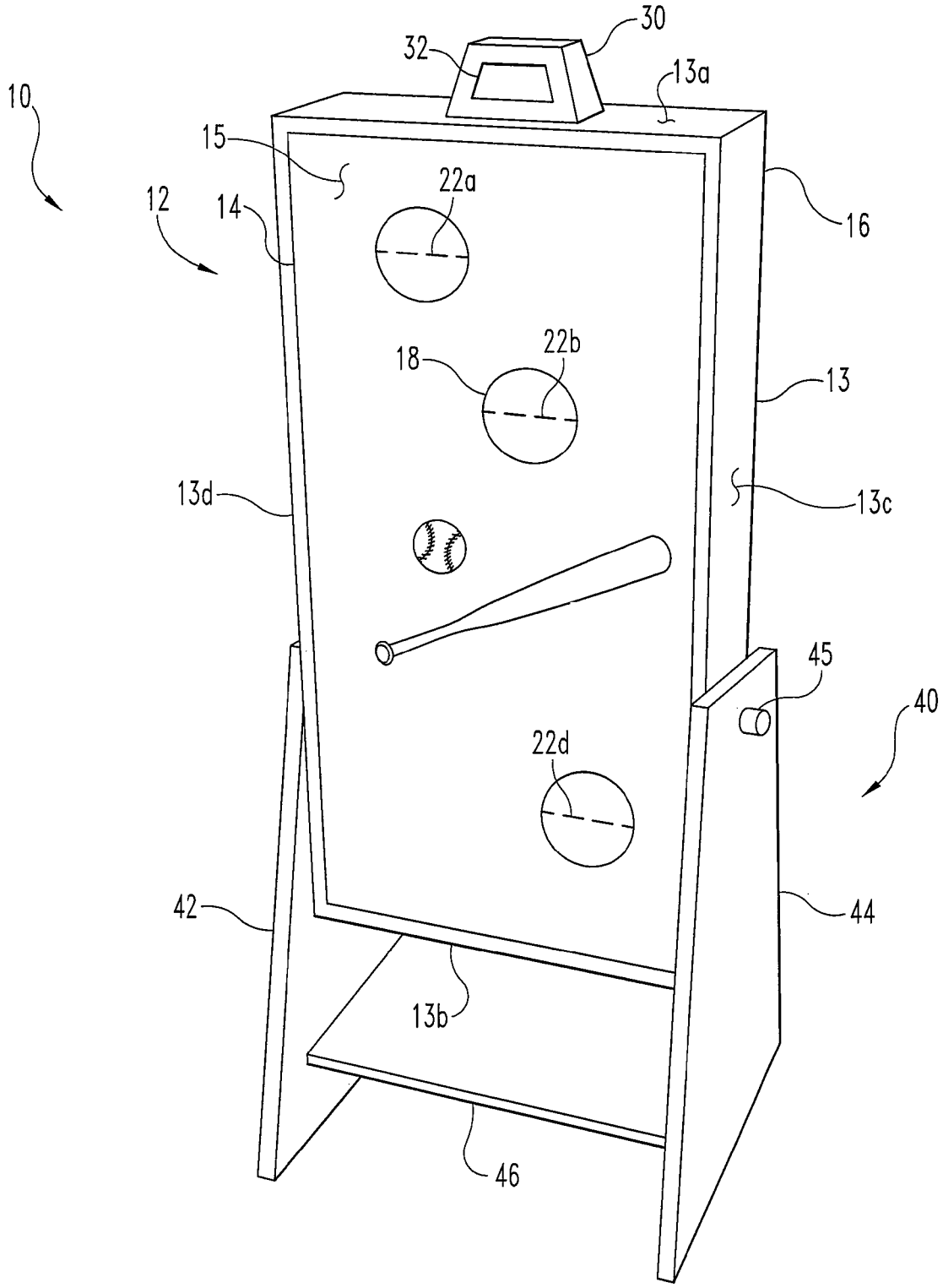
FIG. 1 is a perspective view of a projectile passing game system according to an embodiment of the present disclosure.
Figure 2:
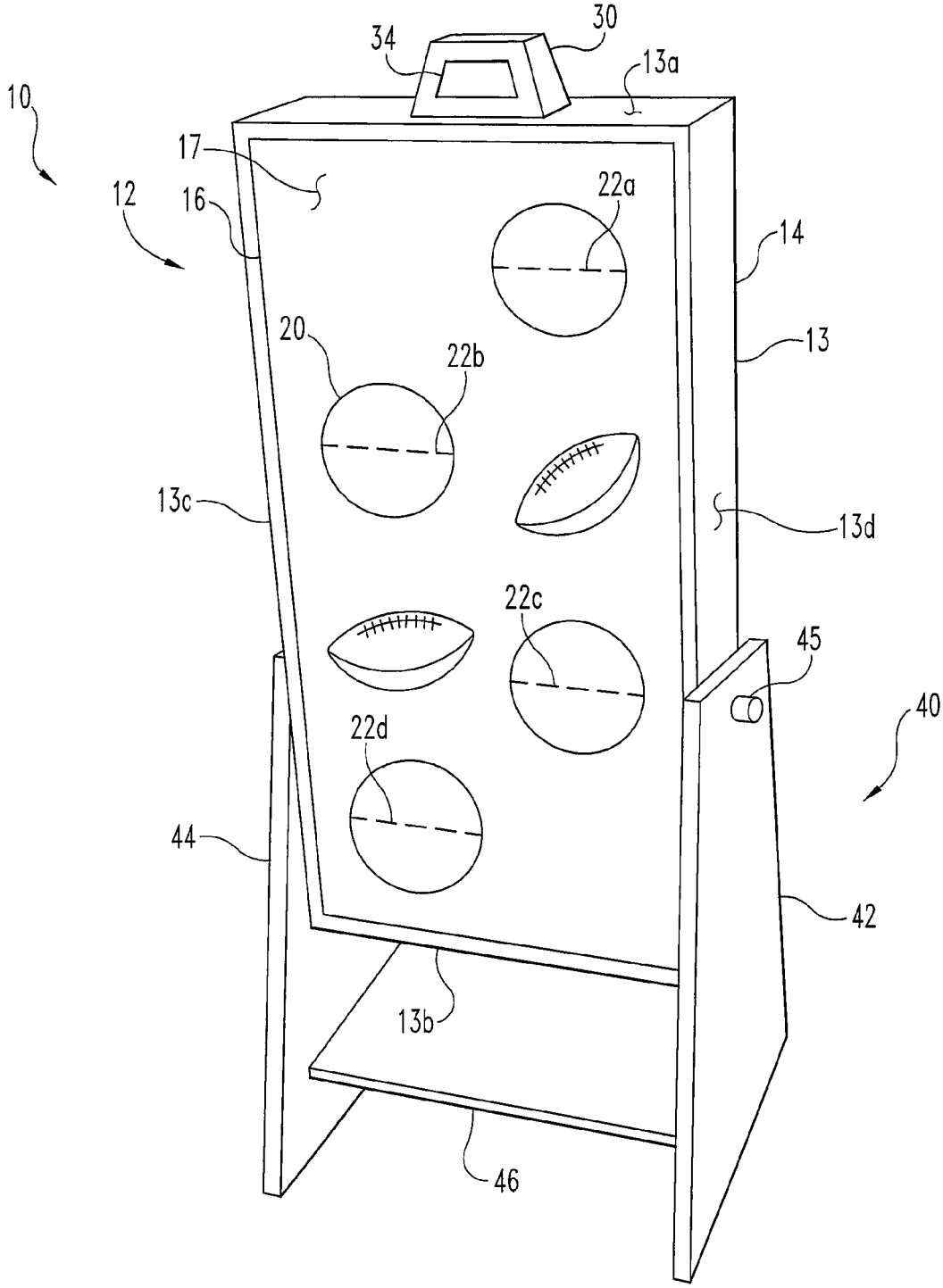
FIG. 2 is another perspective view of the projectile passing game system of FIG. 1.

With specific reference to FIGS. 1 and 2, perspective views of a dual-sided projectile passing game system 10 according to one example embodiment of the present disclosure are illustrated. System 10 includes a multi-game device 12 with a base frame and backboard assembly including a central frame 13 to which target panels 14 and 16 are engaged. Target panels 14 and 16 include target surfaces 15 and 17, respectively, representing two different projectile-passing games, such as baseball and football as illustrated examples. As shown, the target surfaces 15 and 17 define target holes 18 and 20, respectively, through which the projectiles may be passed. The system 10 includes sensors positioned between the target panels 14 and 16, the set of sensors being operable to detect passage of the projectiles through the defined target holes in either of the target panels. In this particular embodiment, the set of sensors includes a plurality of sensor beams extending horizontally within frame 13 of device 12, including at least four sensor beams 22*a* through 22*d* in the particular illustrated embodiment. Device 12 may also optionally include an electronic display 30 mounted to frame 13 for displaying one or more game status indicators, such as scoring and/or timing.

In the illustrated embodiment, frame 13 and target panels 14 and 16 are rectangular in shape. However, it should be appreciated that the shape and size of the frame and target panels and surfaces is not critical to the present disclosure. Frame 13 includes opposing top and bottom 13*a* and 13*b*, respectively, and opposing sides 13*c* and 13*d*. In certain embodiments, target panels 14 and 16 may be engaged with frame 13 via a channel or groove engagement, with frame 13 defining channels or grooves configured to receive the edges of rigid or flexible target panels. In other embodiments, removable brackets or similar fasteners may be used to secure the target panels to the frame. The target panels may be mounted to or otherwise engaged with the frame in a variety of appropriate manners as would occur to one of ordinary skill in the art. In certain embodiments, the target panels may be removably engaged with both sides of the frame, such that the panels can be selectively interchanged by a user. In such embodiments, multiple different target panels may be provided with the game system, allowing a user to select and interchange target panels engaged with the frame depending on the desired game to be played. In other embodiments, the target panels may be permanently or non-removably engaged with the frame.

Additionally, in certain embodiments, the target panels 14 and 16 may each be 1-sided with respect to the target surfaces, such that the back sides of the target panels opposite target surfaces 15 and 17 are blank. In other embodiments, the target panels 14 and 16 may be dual-sided, with other games being depicted on other target surfaces opposite the illustrated target surfaces 15 and 17. In such embodiments, the target panels may be removed from engagement with frame 13 and reversed, such that the opposite side of the target panel presents a different game-playing target surface toward the player position.

In certain optional embodiments, frame 13 may incorporate a projectile return system such as a ramp below an open lower end of the frame to return projectiles received within the frame to a pickup position convenient for the player.

Frame 13 may be held above a support surface via a variety of appropriate support pieces, including the illustrated stand 40 as one non-limiting example. The illustrated stand 40 includes opposing side supports 42 and 44 and an optional lateral support 46. In the illustrated embodiment, frame 13 is mounted to side supports 42 and 44 of support stand 40 at sides 13*c* and 13*d* respectively via opposing side connectors 45. However, it should be appreciated that the frame 13 may be mounted to stand 40 in other appropriate manners. Alternately, frame 40 may be positionable directly on a support surface, with no support stand being provided. Lateral support 46 may optionally be angled toward one side or switchably angled toward a selected side to direct projectiles back to a user.

Frame 13 may be rigidly or non-moveably mounted to support stand 40 so that the panels 14 and 16 (and thus target surfaces 15 and 17) remain stationary and non-moving, with the frame and panels being fixed in a vertical position. Players may pass projectiles toward panels 14 and 16 from opposing player positions on either side of the device 12, depending on the desired game to be played. In alternative embodiments, frame 13 may be rotatably mounted so that the frame 13 may be selectively pivoted about a horizontal axis to position the desired target panel and surface facing a particular player's position and/or to angle the target panels and target surfaces as desired. In such embodiments, the frame 13 may be selectively locked in the desired position after rotation. As an example, if the player desires to switch games, the frame 13 may be rotated to position the other target panel facing the player position. In this way, the device 12 may be situated in a room so that one side of the device is more accessible than the other, such as near or against a wall surface, yet allowing use of both sides.

Figure 3:
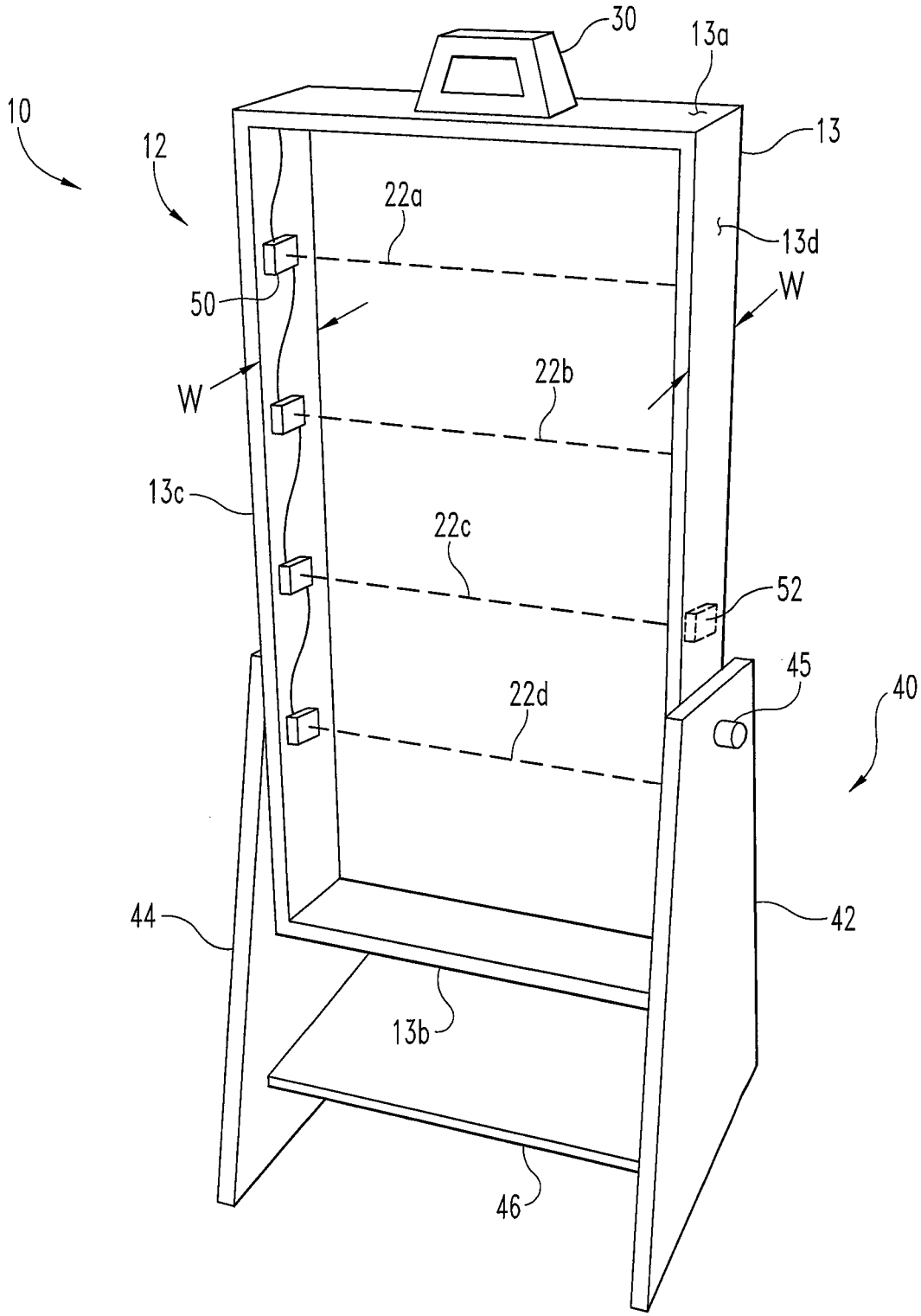
FIG. 3 is an internal perspective view of the projectile passing game system of FIG. 1.

As shown in the accompanying figures, the target holes 18 and 20 are each preferably aligned with at least one sensor beam, so that the sensor beam may register the passage of a projectile passed through the corresponding target hole. FIG. 3 provides a perspective view of the multi-game device 12 with target panels 14 and 16 removed to better illustrate one possible sensor beam arrangement.

FIG. 3 provides a perspective view of the multi-game device 12 with target panels 14 and 16 removed to better illustrate one possible sensor beam arrangement. As shown in FIG. 3, sensor beams 22*a* through 22*d* extend horizontally within the interior of frame 13 between opposing sides 13*c* and 13*d*. In certain embodiments, each sensor beam is defined by a light beam emitter 50 at one end aligned with a light beam receiver 52 at the other end. The light beam emitter may generate a light signal such as an infrared light beam modulated at a frequency that can be detected by the aligned detector without interference from ambient light or being accidentally activated by surrounding conditions. In certain embodiments, the emitters 50 and receivers 52 may be arranged so that the sensor beams are centrally positioned along the width W of opposing sides 13*c* and 13*d*. In this way, the sensor beams are equidistant from the opposing target panels carrying the target surfaces. However, it should be appreciated that other appropriate sensor beam designs or configurations may be utilized to detect passage of projectiles as would occur to one of ordinary skill in the art.

In a preferred embodiment, each sensor beam and target hole combination is arranged such that a projectile passing through the target hole will automatically intercept and break the beam of the corresponding light sensor emitter/receiver pair. When a projectile breaks a light beam, the sensor sends an appropriate signal to an electrical controller that a projectile has been detected.

As shown in the accompanying figures, the target holes 18 and 20 are each preferably aligned with at least one sensor beam, so that the sensor beam may register the passage of a projectile passed through the corresponding target hole. In the particular illustrated embodiment, sensor beams 22*a*, 22*b* and 22*d* are aligned with one target hole each in surface 15 and one target hole each in surface 17 along respective horizontal axes. In other words, each sensor beam can be aligned with two target holes—one in each target surface. In certain embodiments, a sensor beam may be aligned with only one target hole, either in surface 15 or surface 17. In the illustrated version, sensor beam 22*c* is only aligned with a target hole in surface 17.

The target holes in the opposing target surfaces may be vertically and/or horizontally offset so that no hole in surface 15 is directly aligned with a hole in surface 17, such that so that projectiles passed through one target hole are captured within the device. Alternately, the target holes that are positioned along the same horizontal axis may be aligned with each other so that projectiles passed through one target hole may continue to pass through the aligned target hole in the opposing target surface.

Figure 4:
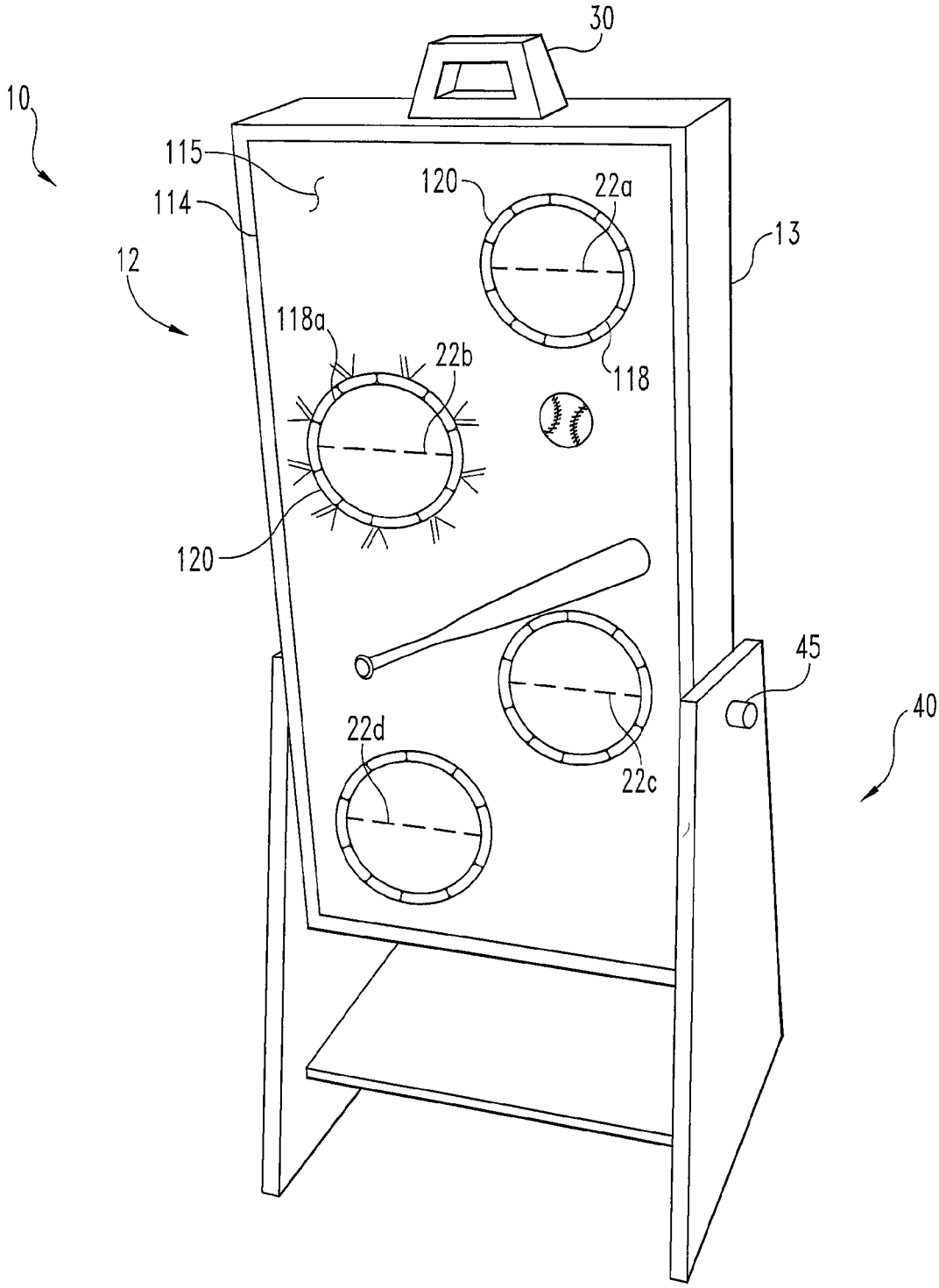
FIG. 4 is a perspective view of a projectile passing game system according to another embodiment of the present disclosure.
Figure 5:
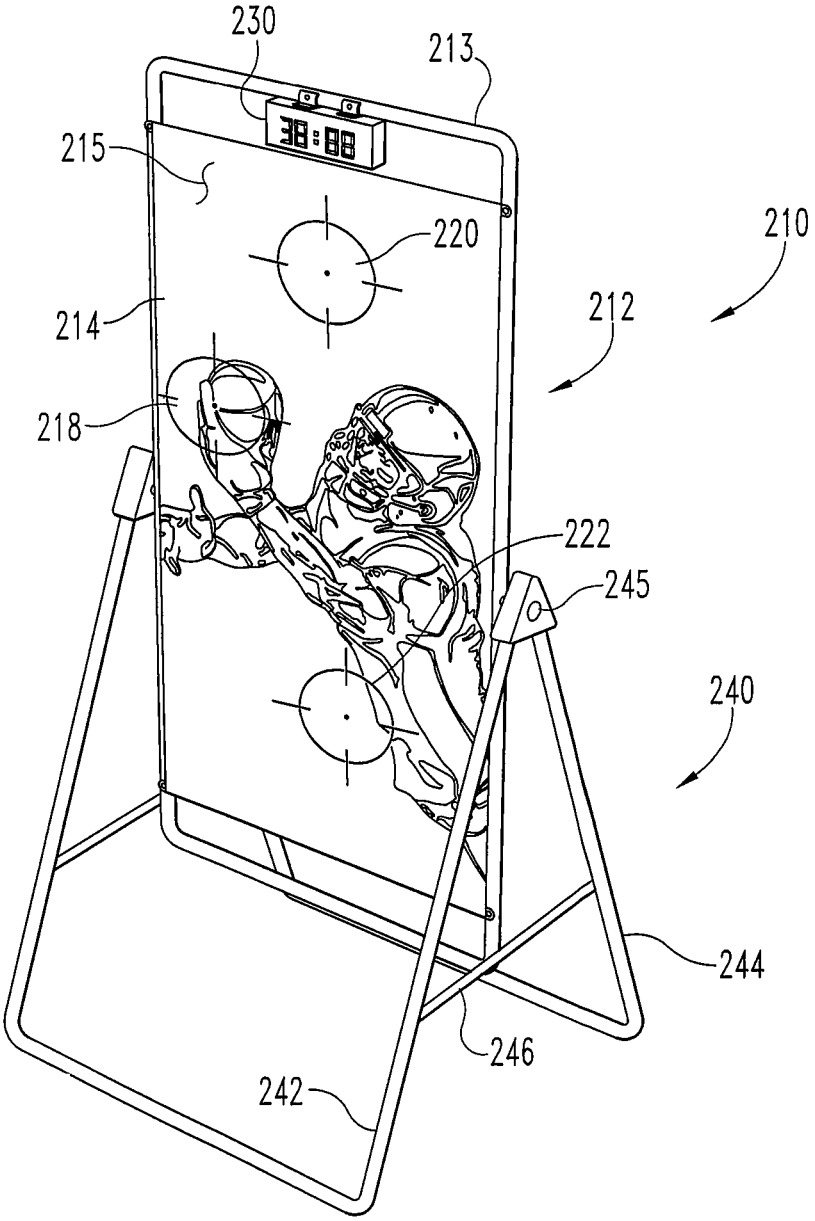
FIGS. 5 and 6 are perspective views of a projectile passing game system according to an embodiment of the present disclosure.
Figure 6:
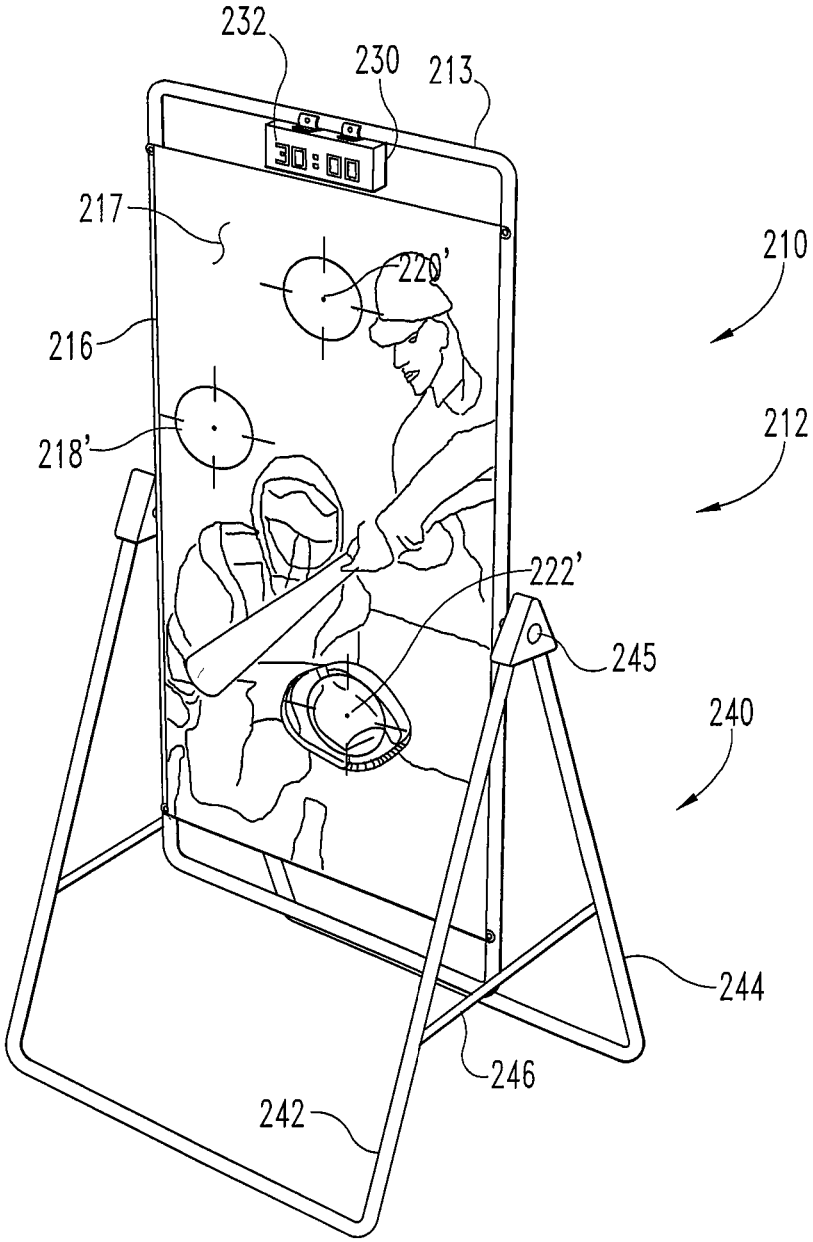
Figure 7A:
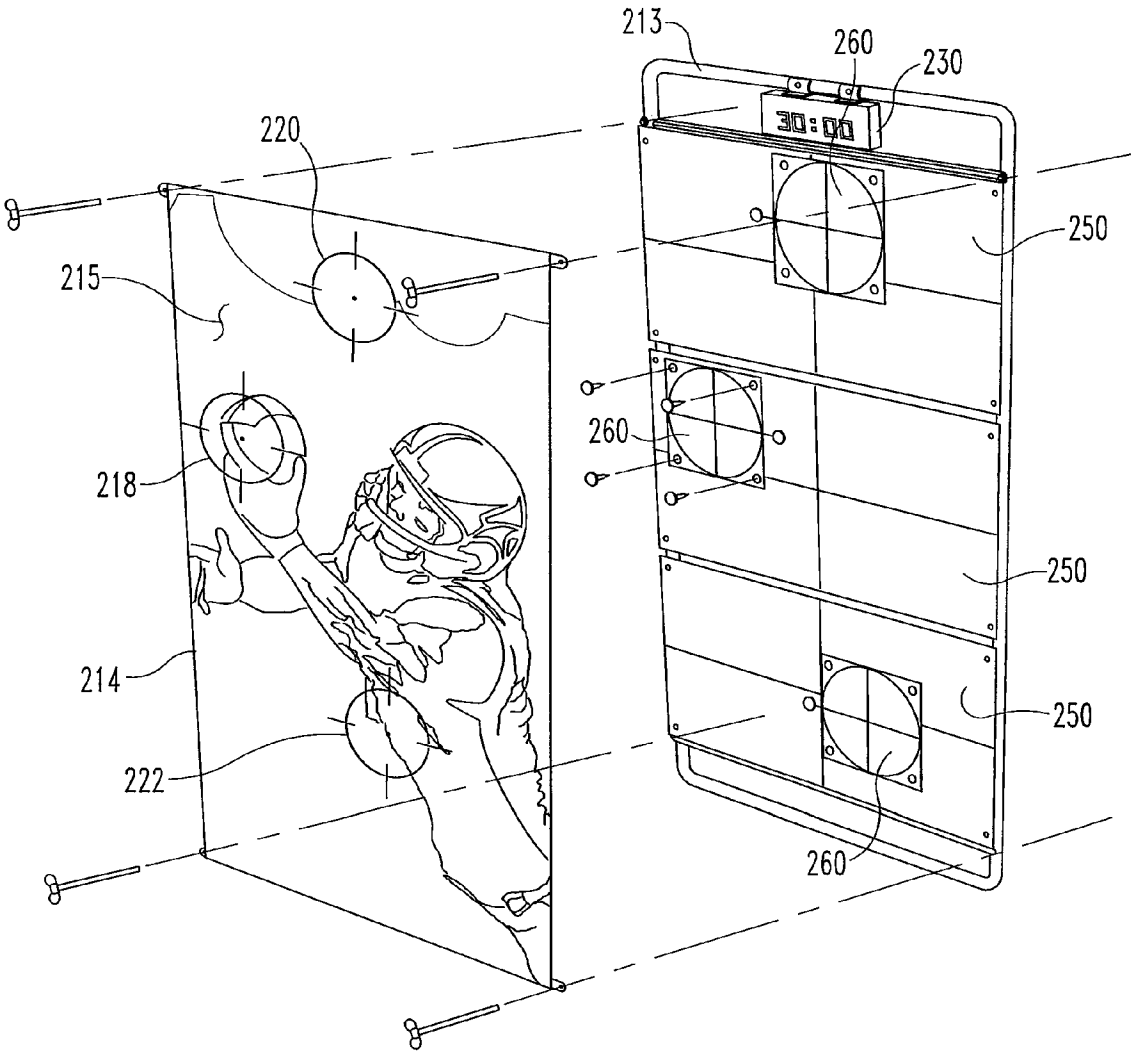
FIG. 7A is an exploded view of the projectile passing game system of FIG. 5.
Figure 7C:
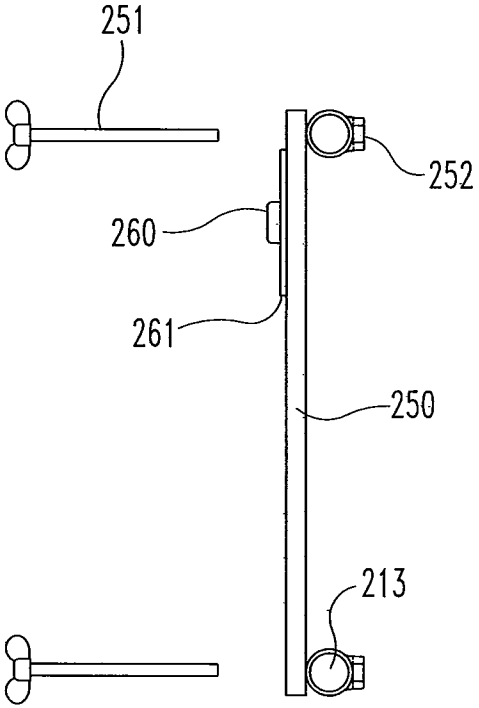
FIG. 7C is a top-down, cross-sectional view of the projectile passing game system of FIG. 7A.
Figure 7B:
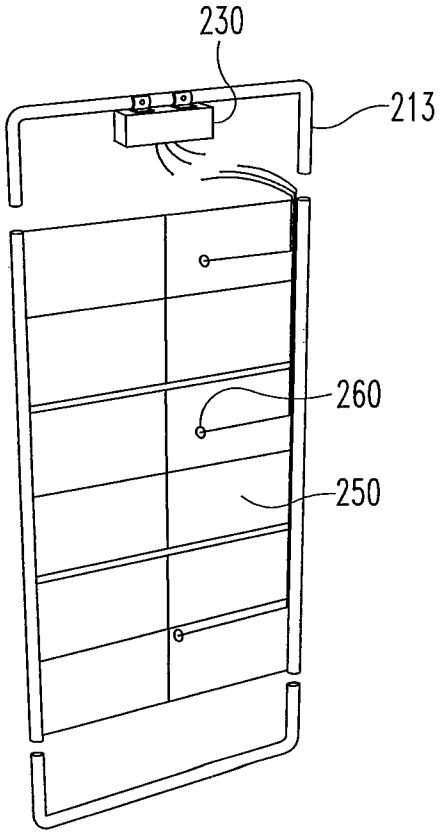
FIG. 7B is a rear view of the projectile passing game system of FIG. 7A.

Referring to FIG. 4, there is shown an embodiment of an illuminating target panel which may be used in conjunction with one or more the projectile passing game systems of the present disclosure. The illustrated panel 114 includes target surface 115 having target holes 118 aligned with the sensor beams 22*a* through 22*d*. The target holes 118 are configured to selectively illuminate to designate a particular scoring target. The target holes 118 may illuminate randomly or according to various predefined sequences. Additionally, the target holes 118 may individually illuminate or illuminate in groups of two or more.

The target panel 114 may be configured and designed to illuminate via a variety of appropriate illuminating mechanisms. In the particular illustrated embodiment, each target hole 118 is surrounded by a plurality of lights 120, such as LEDs, to illuminate when activated to designate the corresponding target hole. It is contemplated that the plurality of lights 120 surrounding a particular target hole 118 may illuminate simultaneously or sequentially so as to create a light chasing effect around the hole, or may illuminate in other appropriate patterns.

In the illustrated embodiment, the lights 120 surrounding particular target hole 118*a* are depicted as illuminated to designate target hole 118*a* as the intended scoring target. In certain embodiments, a player is rewarded for passing a projectile through the particular illuminated scoring target, such as hole 118*a* in FIG. 4. Accordingly, the controller and/or sensor beams may be operable to differentiate between passage of a projectile through the illuminated scoring target hole and passage through a non-illuminated target hole to properly score points. When a projectile breaks a sensor beam associated with an illuminated target hole, the sensor sends an appropriate signal to the controller that a projectile has been detected and to score points accordingly.

Illustrated in FIGS. 5-7C are views of a projectile passing game system 210 according to another embodiment of the present disclosure. System 210 includes a multi-game device 212 with a base frame and backboard assembly including a central frame 213 to which target panels 214 and 216 can be mounted. Target panels 214 and 216 carry two different projectile-passing game target surfaces 215 and 217. As examples, the illustrated target surfaces represent the games of baseball and football. As shown, the target surfaces define impact areas or target zones 218, 220 and 222 or 218', 220' and 222', respectively, towards which the projectiles may be passed. The system 210 includes a set of impact sensors 260 arranged on rigid backboard panels 250, the sensors being operable to detect an impact of the projectiles in a target zone. Device 212 may also optionally include an electronic display 230 mounted to frame 213 for displaying one or more game status indicators 232, such as scoring and/or timing.

In the illustrated embodiment, frame 213 and target panels 214 and 216 are rectangular in shape. However, it should be appreciated that the shape and size of the frame and target panels is not critical to the present disclosure. Frame 213 includes opposing top and bottom ends respectively, and opposing lateral sides. In one particular embodiment, target panels 214 or 216 may be formed with a rigid or flexible material having upper and lower sleeves which receive upper and lower bars, which may be mounted to frame 213 to tautly secure the panel in place. As an example, fasteners such as wing nut bolts extend through the upper and lower bars, through a backboard panel 250 and into frame 213 to secure the panel in place. The bolts may engage threading of or within frame 213, or may engage a loose or secured nut on the opposing or rear side of frame 213. In other embodiments, removable brackets or alternate fasteners may be used to secure the target panels to the frame. As an alternative example, the panels may be removably secured to the frame through the use of hook and loop fasteners. The target panels may be mounted to or otherwise engaged with the frame in a variety of other appropriate manners as would occur to one of ordinary skill in the art.

In certain embodiments, the target panels may be removably engaged with the same side of the frame, such that the panels can be selectively interchanged by a user. In such embodiments, multiple different target panels may be provided with the game system, allowing a user to select and interchange target panels to be engaged with the frame depending on the desired game to be played.

Additionally, in certain embodiments, the target panels 214 and 216 may each be 1-sided with respect to the target surfaces, such that the back sides of the target panels opposite target surfaces 215 and 217 are blank. In other embodiments, the target panels 214 and 216 may be dual-sided, with other games being depicted on other target surfaces opposite the illustrated target surfaces 215 and 217. In such embodiments, the target panels may be removed from engagement with frame 213 and reversed, such that the opposite side of the target panel presents a different game-playing target surface toward the player position. Although the illustrated target surfaces 215 and 217 are carried on two different target panels, in other embodiments, the illustrated target surfaces may occupy opposing surfaces of the same reversible target panel.

In certain optional embodiments, frame 213 may incorporate a projectile return system such as a ramp below an open lower end of the frame to return projectiles passed toward the panel to a pickup position convenient for the player.

In the particular illustrated embodiment, there are three backboard panels 250 mounted to frame 213, each panel 250 carrying an impact sensor 260. As illustrated in the partial view of FIG. 7C, fasteners such as wing bolts 251 may be used to secure the panels to frame 213, in cooperation with nuts 252. However, it should be appreciated that the backboard panel(s) may be mounted to frame 213 in a variety of other appropriate manners. Additionally, in other embodiments, the backboard may consist of a single sheet of material mounted to frame 213.

Frame 213 may be held above a support surface via a variety of appropriate support pieces, including the illustrated stand 240 as one non-limiting example. The illustrated stand 240 includes supports 242 and 244 and lateral braces 246. Frame 213 may be fixedly or rotatably mounted at the junction connecting supports 242 and 244 via opposing side connectors 245. Frame 213 may also be secured adjacent its lower end to lateral braces 246 to inhibit rotation during play. Optionally, frame 213 can be connected at aligned locations along lateral braces 246, for example using clamps or pins, to angle frame 213 in order to change the game playing dynamics. It should be appreciated that the frame 213 may be mounted to stand 240 in other appropriate manners, either movably or non-movably. Alternately, frame 213 may be based upon on a horizontal support surface and/or mounted to a vertical support surface, without support stand 240.

Illustrated in FIGS. 8A-8C are views of another embodiment of a projectile passing game system. System 310 includes a multi-game device 312 with a base frame and backboard assembly including a central frame 313 to which target panel 314 can be removably engaged. Target panel 314 includes target surfaces 315 and 317 on opposing sides thereof, the target surfaces representing two different projectile-passing games, such as baseball and football as illustrated examples. Each target surfaces defines target zones, for example target zones 318, 320 and 322 on surface 315, towards which the projectiles may be passed. The system 310 includes a single set of impact sensors 360 arranged in pockets 356 on a backboard panel 350, the sensors being operable to detect an impact of the projectiles in a target zone. System 310 may also optionally include an electronic display 330 mounted to frame 313 for displaying one or more game status indicators 332, such as scoring and/or timing.

In the illustrated embodiment, frame 313 and target panel 314 are rectangular in shape. However, it should be appreciated that the shape and size of the frame and target panel is not critical to the present disclosure. Frame 313 includes opposing top and bottom sides respectively, and opposing lateral sides. A backboard panel 350 is mounted within frame 313 and secured to frame 313, for example with straps 352. In certain embodiments, backboard panel 350 and/or straps 352 are flexible and have elastic properties to allow flexibility and a rebound effect when a projectile impacts the target. Straps 352 can include closed loops or may be adjustable to adjust tautness and the rebound characteristics of the backboard panel 350. Additionally, the straps 352 may optionally be closed with removable fasteners such as hook and loop fasteners, buckles, buttons or snaps to allow the backboard panel 350 to be removed from frame 313.

Target panel 314 may be formed with a rigid or flexible material arranged between upper and lower ends. The panel is preferably mountable to or over backboard panel 350, with the target zone impact areas aligned with sensors 360. Additionally, the panel is preferably removably engaged with the backboard panel, such that the panel may be selectively removed, reversed and re-engaged to face a different game-playing surface toward the player position when it is desirable to play a different game. In the illustrated example, removable fasteners such as VELCRO® type hook and loop fasteners are used at the upper and lower ends to secure the target panel to the backboard. In other embodiments, removable fasteners can secure the target panel to the backboard along the lateral edges or in the interior area. Alternate examples of fasteners include lacing, snaps, buttons or zippers.

In certain embodiments multiple target panels may be removably engaged with the frame or backboard panel, such that the panels can be selectively interchanged by a user. In such embodiments, multiple different target panels may be provided with the game system, allowing a user to select and interchange target panels to be engaged with the frame depending on the desired game to be played. The target panels may be 1-sided or 2-sided. Additionally, in alternative embodiments, the illustrated target panel 314 may be 1-sided with respect to the target surfaces, such that one side of the target panel is blank. In such embodiments, the illustrated target surfaces 315 and 317 may be carried on two different target panels.

Frame 313 may be held above a support surface via a variety of appropriate support pieces, including the illustrated stand 340 as one non-limiting example. The illustrated stand 340 includes opposing supports 342 and 344 and lateral braces 346. In the illustrated embodiment, frame 313 is rotatably or fixedly mounted at the junction connecting supports 342 and 344 via connectors 345. Frame 313 may be secured adjacent its lower end to lateral braces 346. Optionally, frame 313 can be connected at aligned locations along lateral braces 346, for example using clamps or pins, to angle frame 313 to change the game playing dynamics.

As an additional option shown in the embodiment of FIGS. 8A-8C, but usable in other embodiments, a panel of material 348 may extend as a ramp between front support 342 and the lower edge of frame 313. For example, panel 348 may include a sleeve which is mounted on support 242 and may include ties or straps 349 which can be secured to the lower edge of frame 313. Panel 348 preferably assists in catching a falling projectile and returning the projectile towards a player position.

Illustrated in FIG. 9 is yet another example embodiment of a projectile passing game system according to the present disclosure. System 410 includes a multi-game device 412 with a base frame and backboard assembly including a central frame 413 to which target panel 414 can be removably engaged. Target panel 414 includes target surface 415 on one side thereof. Target panel 415 may optionally include a different target surface on the opposing side from surface 415, with the two target surfaces representing two different projectile-passing games. Target surface 415 defines target zones, for example target zones 418, 420 and 422, towards which the projectiles may be passed. In the particular illustrated embodiment, the target surface 415 is designed for playing soccer, with the target surface and frame being orientated horizontally to better position the target surface for the game of soccer.

The system 410 includes a single set of impact sensors arranged on a backboard panel, the sensors being operable to detect an impact of the projectiles in a target zone. The arrangement of the impact sensors and backboard panel may be similar to the arrangement shown in FIG. 8B, with the impact sensors being positioned in pockets attached to the backboard panel. However, it should be appreciated that the impact sensors can be configured and arranged in other manners as would occur to one of ordinary skill in the art. Additionally, system 410 may also optionally include an electronic display 430 mounted to frame 413 for displaying one or more game status indicators, such as scoring and/or timing.

In the illustrated embodiment, frame 413 and target panel 414 are rectangular in shape. However, it should be appreciated that the shape and size of the frame and target panel is not critical to the present disclosure. Frame 413 includes opposing top and bottom sides respectively, and opposing lateral sides. A backboard panel (not shown) may be mounted within frame 413 and secured to frame 413, for example with straps 452. In certain embodiments, the backboard panel and/or the straps are flexible and have elastic properties to allow flexibility and a rebound effect when a projectile impacts the target. Straps 452 can include closed loops or may be adjustable to adjust tautness and the rebound characteristics of the backboard panel. Additionally, the straps 452 may optionally be closed with removable fasteners such as hook and loop fasteners, buckles, buttons or snaps to allow the backboard panel to be removed from frame 413.

Target panel 414 may be formed with a rigid or flexible material arranged between upper and lower ends. The panel is preferably mountable to or over the backboard panel, with the target zone impact areas aligned with the impact sensors. Additionally, the panel is preferably removably engaged with the backboard panel, such that the panel may be selectively removed, and either the same panel or a different panel engaged with the device to face a different game-playing surface toward the player position when it is desirable to play a different game. As an example, removable fasteners such as VELCRO® type hook and loop fasteners may be used at the upper and lower ends to secure the target panel to the backboard. In other embodiments, removable fasteners can secure the target panel to the backboard along the lateral edges or in the interior area. Alternate examples of fasteners include lacing, snaps, buttons or zippers.

In certain embodiments multiple target panels may be removably engaged with the frame or backboard panel, such that the panels can be selectively interchanged by a user. In such embodiments, multiple different target panels may be provided with the game system, allowing a user to select and interchange target panels to be engaged with the frame depending on the desired game to be played. The target panels may be 1-sided or 2-sided.

Frame 413 may be held above a support surface via a variety of appropriate support pieces, including the illustrated stand 440 as one non-limiting example. The illustrated stand 440 includes opposing supports 442 and 444 and lateral braces 446. In the illustrated embodiment, frame 413 is rotatably or fixedly mounted at the junction connecting supports 342 and 344 via connectors 445. Frame 413 may be secured adjacent its lower end to lateral braces 446. Optionally, frame 413 can be connected at aligned locations along lateral braces 446, for example using clamps or pins, to angle frame 413 to change the game playing dynamics.

In certain optional embodiments, frame 413 may incorporate a projectile return system such as a ramp below an open lower end of the frame to return projectiles passed toward the panel to a pickup position convenient for the player.

In alternative embodiments, various other types of mechanisms capable of detecting the presence of a projectile, such as through sensing the passage of a projectile through a hole or the impact of a projectile against a target zone, may be used in connection with one or more of the embodiments discussed herein. As an example, mechanical sensors which are operable to create electrical signals may be used. Examples of mechanical sensors include sensor arms, touch sensors, sensor wires or sensor switches, alone or in combination. In such embodiments, an electrical signal is triggered by the projectile touching the sensor which then generates a signal to be sent to an electrical controller providing an indication that a projectile has been detected. For example, deflection of a mechanical arm may trigger an electrical contact or switch. The sensors are preferably reset automatically following detection of the projectile. Alternatively, there may be a reset activation button configured to reset the triggered sensor.

Additionally, the illustrated target holes and target zones in the embodiments discussed herein are circular in shape and all of uniform size, but may be shaped and sized otherwise as desired, so long as the targets are large enough to receive the corresponding projectiles and are aligned with the sensors. In other embodiments, the target holes and/or zones in the same target panel may be of various sizes aligned with one or more sensors, with the various sizes in corresponding levels of difficulty and reward if projectiles successfully pass through the target hole or impact the target zone. Typically, the largest target would have the lowest difficulty and lowest reward.

In various embodiments, lights may be used in connection with the target panels (such as the illustrated lights 120 on target panel 114) to create illuminating target panels. As an example, target holes may be configured to selectively illuminate to designate a particular scoring target. Additionally, one or more of the target panels discussed herein may include lights configured to provide a decorative aspect to the system, such as illuminating when the device is turned on to gain attention. Additionally, one or more of the gaming systems discussed herein may be equipped with a sound mechanism to provide sound effects at predetermined events, such as when the device is turned on and/or when points are scored, to name a few non-limiting examples. Further, one or more of the panels discussed herein may be decorated with various indicia to gain attention and/or reflect the game being played.

System 10, 210, 310 and/or 410 may also include an electronic controller (not shown) with an internal processor to control the operations of the system. In certain embodiments, the electronic controller may be consolidated with the electronic display of the system in the same casing. The electronic controller may be operably connected to each of the sensors and the display. In such embodiments, the internal processor in the electronic controller is governed by specified rules to define and change the status of the game in response to input from the sensor beams and to then reflect the game status on the electronic display. Standard wiring and plugs (including the wiring shown in FIG. 3 as an example) may be used to connect the sensors to the controller. For clarity, many of the electrical components are not illustrated.

In some embodiments, the electronic controller may be configured to update the status of two independent games being played with respect to two different target surfaces. In such embodiments, the sensing system may be operable to determine the direction from which a projectile was passed and thus the particular target surface which the projectile passed through or impacted, and send corresponding signals to the electronic controller. In this option, two games or two separate activities, such as a race, may be played simultaneously, for example with projectiles being passed by one player toward targets in a front target panel and projectiles being passed by another player toward targets in a rear target panel.

Each system may also include a control box (not shown) for selecting various control functions. The control box may include buttons for turning the power on/off, a pause (time-out) button, a game selector, score and time adjustments and/or other appropriate buttons as would occur to one of ordinary skill in the art. Additionally, the control box may be operatively coupled with the electronic display.

The electronic display may display the score of the game and/or the number of projectiles that have successfully reached a target. Additionally, the electronic display may display the timing of the game, for example a timing countdown for each player to attempt to successfully pass as many projectiles as possible. It should be appreciated that the display may show other game status indicators as would occur to one skilled in the art. As examples, the display may show the player or team names, an indication of the player passing the projectiles, the high scores, the scoring records, etc.

In the particular illustrated embodiment of FIG. 1, display 30 includes a first display screen 32 facing a first direction and a second display screen 34 facing a second opposite direction. In this way, the game status of the game being played with respect to target panel 14 may be shown on display screen 32 and the game status of the game being played with respect to target panel 16 may be shown on display screen 34. In embodiments in which only one game may be played at a time, the game status of the particular game being played may be shown on both screens, or alternately, only one screen may be present. As examples, the screen(s) of the electronic displays may embody light emitting diodes (LEDs), a liquid crystal display (LCD) or a small television screen or computer monitor. In certain embodiments, the indicia shown on the screen(s) are digital and illuminated, with sufficient size to allow for easy viewing by the players and audience. In alternate embodiments, display 30 may include only one display screen and may be rotatably mounted to the frame 13. In such embodiments, the display 30 may be rotated by a user to position the display screen facing the desired direction, so that the display screen is visible from the side of the device being used. Although display 30 is shown as being mounted to top 13*a* of frame 13 in the illustrated embodiment, it should be appreciated that display 30 may mounted or otherwise engaged with frame 13 at other locations, including along sides 13*c* or 13*d* as examples. In a particular illustrated example, display 430 shown in FIG. 9 is mounted along a side of frame 413.

The displays contemplated by the present disclosure may be mounted to the corresponding frames in a variety of appropriate manners. For example, fasteners such as bolts and screws may be used to secure the display to the frame. As other examples, brace and fastener combinations may be used to mount displays 230, 330 and 430 to the corresponding frames. A particular example is illustrated in FIG. 8C with respect to display 330, showing braces 380 and fasteners 381 used to secure display 330 to a portion of frame 313.

When playing a game using a system herein, a player stands in front of the desired target surface. The player attempts to pass a projectile through a target hole or towards a target zone, such as a football through one of the target holes 20 in target panel 16 or a baseball through one of the target holes 18 in panel 14 as examples. When the projectile successfully passes through a target hole and breaks a sensor beam or impacts a target zone, an appropriate signal is sent to the controller of the device and the game status is updated. The player position distance from the device may be increased to raise the difficulty level.

Additionally, in optional embodiments, components of the gaming systems contemplated by the present disclosure may be equipped with one or more impact sensors for detecting when a projectile misses a target hole or target zone and impacts the target surface elsewhere As examples, impact sensors may be mounted on the rear side of the target panels or on the backboard panels. The impact sensors may be triggered when they detect an impact force from a projectile against the target surface at a missed location. Such impact sensors may be operably connected to the electronic controller and/or display for the device to define and change the status of the game in response to input from the impact sensors. In certain embodiments, a reduction in scoring points may occur if a projectile impacts the target panel and triggers an impact sensor without reaching a defined zone. As another example, a penalty designation or negative game status indication, such as a strike in baseball, may be assigned.

As discussed above, some embodiments provide for multiple target panels which may be interchangeable to enable various different games to be played with a particular device. In some embodiments, a base target panel may be non-removably engaged with the frame, with additional target panels being placed over the base panel as desired. In such embodiments, the target holes or impact zones defined in the additional target panels must at least partially align or overlap the target holes or impact zones defined in the base panel so that projectiles may interrupt the corresponding sensor beam or to impact the corresponding impact sensor. In other embodiments, the panels may be removed from engagement with the frame and replaced by other target panels. In such embodiments, the replacement target panels necessarily must include target holes or impact zones aligned with sensors on the corresponding device.

The components of the systems discussed herein can be manufactured and assembled from standard materials, such as wood, plastic or metal based materials as examples. The target panels preferably do not substantially permanently deform or indent when projectiles strike the target panels. The projectiles used may be standard or regulation projectiles, or may be made of softer materials and/or reduced in size as appropriate for indoor, reduced-scale game use. Preferably, the overall size of each system is sized to fit within a room with a standard eight foot ceiling. Additionally, a system may be portable to enable the device to be positioned at various locations within a room. In certain embodiments, the systems may be manufactured in a modular, lightweight form to enhance the ease of transport, assembly and disassembly. The various components of the systems may be mounted or engaged together with simple wood screws, nuts and bolts or similar fasteners.

In certain embodiments, the frames may be formed with multiple sections, such as fitted pipe sections. In this way, the frames may be configurable, allowing users to configure the frames in different sizes and configurations. In such embodiments, the systems may be provided as kits having multiple frame sections so that the user may configure the frame as desired.

Additionally, the frames of the game systems disclosed herein may be rotatable with respect to the corresponding stands. In such embodiments, the connectors (such as connectors 45, 245, 345 and/or 445) may engage with the frames in a manner to allow for rotation of the frames. Additionally, the systems may include locking mechanisms to selectively lock the frames at the desired orientations. In certain embodiments, the frames may be positioned at a plurality of angled positions. In addition to angled positions, a player may desire to rotate the frame 180 degrees from one vertical position to the inverted vertical position. In this way, the player is able to switch games by positioning a different target surface facing the player position.

As mentioned above, the frames may be secured adjacent their lower ends to the corresponding lateral braces to selectively lock the frames and inhibit rotation during play. In one particular embodiment, the lateral braces and the side members of the frames may include a plurality of holes. The frame may be rotated as desired until a hole in the frame is aligned with a hole in the lateral brace, so that a locking pin or similar fastener can be inserted through the aligned holes. It should be appreciated that the number, arrangement and positioning of the holes may vary as would occur to one of ordinary skill in the art. It should also be appreciated that other selective locking mechanisms may be employed as would occur to one of ordinary skill in the art. In alternative embodiments, the holes and locking pins are absent and the connectors serve as the sole selective locking mechanism for the systems.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

What is claimed:

1. A game system, comprising:

a base game-playing structure;

at least two target surfaces each defining at least one target zone, the target surfaces being engageable with the base game-playing structure in one or more substantially vertical orientations and configured to receive passed projectiles, wherein each of the target surfaces depicts a different projectile-passing game to be played with the game system;

at least one sensor engaged with the base game-playing structure;

wherein the target zone is positioned at a location on the corresponding target surface which is aligned with the sensor when the corresponding target surface is engaged with the base game-playing structure, wherein the sensor is configured to detect the presence of a projectile at the target zone when the corresponding target surface is engaged with the base game-playing structure;

an electronic display configured to display the status of the game being played with the game system; and an electronic controller configured to receive signals from the sensor and coupled to the electronic display to reflect the status of the game;

wherein the target zone is a target zone aperture sized to allow for passage of a projectile therethrough;

wherein the sensor is a passing sensor configured to detect if a projectile passes through the target zone aperture and send a signal to the electronic controller;

wherein the base game-playing structure includes a frame having a front side and a back side, wherein the passing sensor is a sensor pair comprising an emitter and a corresponding detector, with the emitter and detector being mounted to the frame between the front and back sides;

wherein the at least two target surfaces includes a first target surface on a first target panel engageable with the front side of the frame and a second target surface on a second target panel engageable with the back side of the frame.

2. The game system of claim 1, wherein the at least two target surfaces occupy opposing front and back sides of a double-sided target panel.

3. The game system of claim 1, wherein the at least two target surfaces are positioned on two discrete target panels which are interchangeably and selectively engageable with the base game-playing structure.

4. The game system of claim 1, comprising an apron mounted to the base game-playing structure extending forward underneath a target surface engaged with the base game-playing structure at a downward angle to receive a projectile and to return the projectile to a player.

* * * * *